United States Patent [19]

Lentz

[11] 4,059,782

[45] Nov. 22, 1977

[54] SPARK PLUG

[75] Inventor: Lawrence R. Lentz, Toledo, Ohio

[73] Assignee: Champion Spark Plug Company, Toledo, Ohio

[21] Appl. No.: 784,045

[22] Filed: Apr. 4, 1977

Related U.S. Application Data

[63] Continuation-in-part of Ser. No. 701,582, July 1, 1976, abandoned.

[51] Int. Cl.[2] ..... H01T 13/20

[52] U.S. Cl. ..... 315/58; 29/25.12; 313/124

[58] Field of Search ..... 313/123, 124, 140; 315/58; 123/169 R, 169 EA, 169 EB, 169 G; 29/25.12

[56] References Cited

FOREIGN PATENT DOCUMENTS

| | | | |
|---|---|---|---|
| 522,778 | 2/1952 | Canada | 313/124 |
| 13,605 of | 1914 | United Kingdom | 313/123 |

*Primary Examiner*—John Kominski

*Attorney, Agent, or Firm*—Oliver E. Todd, Jr.

[57] ABSTRACT

A spark plug having an internal auxiliary spark gap in series with an ignition noise suppressor in a center electrode is disclosed. One side of the series gap is formed by a conductive ball which also supports the suppressor.

2 Claims, 1 Drawing Figure

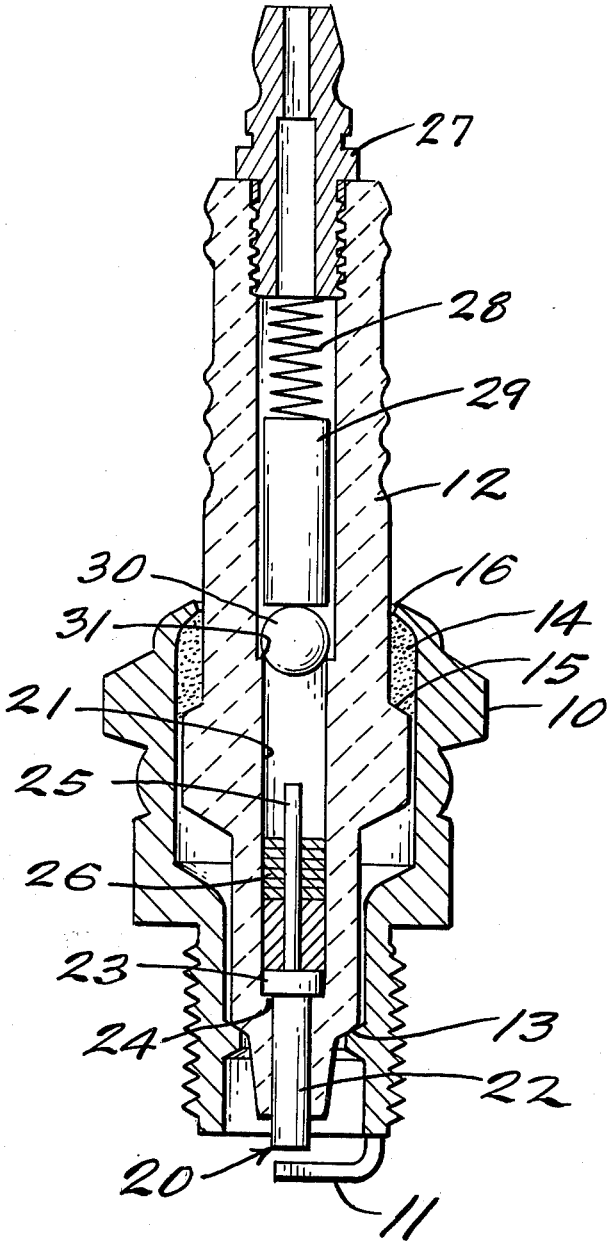
27
28
29
12
30
16
31
14
15
21
10
25
26
23
24
13
22
20
11

SPARK PLUG

CROSS REFERENCE TO RELATED APPLICATION

This is a continuation in part of my copending application Ser. No. 701,582 filed July 1, 1976 now abandoned.

BACKGROUND OF THE INVENTION

Spark plugs are presently on the market that include an internal auxiliary gap in series between upper and lower center electrode sections. The gap is formed between a cylindrical rivet-like element that has a shoulder seated upon a shoulder on a central bore through an insulator and an upper section in contact with a resistor or similar type of ignition noise suppressor. A spring presses the resistor against the rivet-like gap forming element. These spark plugs are made rapidly on automatic machines which feed the parts into the central bore of the insulator in the proper sequence. On occasion the rivet-like gap forming element will not seat properly on its shoulder as it becomes cocked in its seated position. As the remainder of the elements are fed in and sealed there is no way to inspect the plug to ascertain whether the rivet is crosswise or in its proper position. If the rivet is crosswise or at an angle the spark plug is defective, but this is not apparent until a purchaser tries to start and run an engine containing the improperly seated element.

BRIEF STATEMENT OF THE INVENTION

The present invention provides an internal spark gap element which is a spherical conductive ball and thus requires no orientation and which results in an assembly that is always uniform and reliable. The ball also functions as a support for an ignition noise suppression element such as a carbon or wire wound resistor or a low resistance wire wound inductive suppressor.

BRIEF DESCRIPTION OF THE DRAWINGS

In the drawings, FIG. 1 is a central, vertical, sectional view of a spark plug embodying the present invention.

DETAILED DESCRIPTION OF A PREFERRED EMBODIMENT

The invention is shown in a resistor spark plug having a shell 10 adapted to be screwed into a cylinder head of an engine in a conventional manner. A ground electrode 11 is fixed to the lower end of the shell, and an insulator 12 is seated in the shell on a shoulder 13 in a manner well known in the art. The insulator 12 is sealed with respect to the shell by any suitable means such as a body of compacted powder 14 interposed between a shoulder 15 on the insulator and protected by an inturned flange 16 on the shell.

A center electrode 20 mounted in a central bore 21 through the insulator 12 is divided into upper and lower sections. The lower section of the electrode comprises a wire element 22 which protrudes from the insulator 12 into cooperating relationship with the ground electrode 11 for defining a main spark gap. A shoulder or head 23 on the wire element 22 seats on a shoulder or step 24 in the internal insulator bore 21. The wire element 22 has an upstanding extended wire section 25 which forms one side of an internal gap between the lower and upper electrode sections as hereinafter described.

A seal 26 is formed around the wire section 24 against the emission of gases through the bore 23 of the insulator 12.

An upper electrode section comprises an exposed terminal 27, threaded and cemented in the bore of the insulator and contacting a compression spring 28 at its lower end. The spring 28 bears against the upper end of a resistor 29. The lower end of the resistor makes contact with a steel or other electrically conductive ball 30. The ball 30 is seated on a step or shoulder 31 formed in the insulator bore 21 at a precise distance above the end of the wire section 25 and thus forms the upper terminal for an internal or auxiliary spark gap of the spark plug. Since the ball 30 is of a known diameter and the shoulder 31 is precisely located when the insulator is formed the ball 31 will always be at a precise spacing from the wire section 25.

Spark plugs of this nature are assembled on automatic machines and, after the wire element 22 is put into place in the bore 21 and sealed by forming the seal 25, the partially assembled spark plug is taken to an additional machine in which the ball 30 is dropped into the center bore 21 of the insulator 12 and seats on shoulder 31. Thereafter, the resistor 29 is dropped into place followed by the spring 28 and terminal 27. This assembly can be made automatically and very rapidly.

The ball 30 must always assume the same position since it is totally symmetrical with respect to any axis and the gap between the ball 30 and the exposed end of the lower center electrode wire section 25 is thus established. At the present time resistor spark plugs of this nature are assembled with a rivet-like element which is cylindrical with a central shoulder which is intended to seat on the insulator bore shoulder 31. Such cylindrical elements can become cocked during assembly and there is no way to detect the fact that the spark plug has been improperly assembled. The internal gap between the cylindrical section and the wire section 25 of the lower center electrode section thus varies. This will adversely affect the performance of any engine in which the spark plug is installed. Spark plugs of this nature are frequently used in outboard engines where reliable performance is imperative. By substituting the ball electrode 30 for the known cylindrical electrode piece, assembly is facilitated and rejects are eliminated.

It should be noted that the resistor 29 is only one known type of ignition noise suppressor. The resistor 29 may be of compacted carbon or wire wound or of other semiconductor materials. Or, other types of ignition noise suppressors, such as relatively low resistance inductors, may replace the resistor 29. It should be noted that the spring 28 can be of any type known in the art and can be positioned either between the terminal 27 and the suppressor 29 or between the suppressor 29 and the ball 30.

What I claim is:

1. In a spark plug having a shell and an insulator seated in said shell and sealed therein against the passage of combustion gases, said insulator having a stepped central bore, an improved center electrode assembly mounted in said insulator bore comprising a lower center electrode element seated in said bore, said electrode element having first end means for defining one side of a main spark gap exterior to said bore and second end means defining one side of an auxiliary spark gap within said bore, an electrically conductive ball seated on a step in said bore, said ball being spaced from said second end means for defining a second side of such auxialy spark gap, an ignition noise suppressor positioned within said bore, a terminal, and springs means electrically connecting said ball, said suppressor and said terminal in series.

2. An approved center electrode assembly for a spark plug as set forth in claim 1, wherein said spring means comprises a compression spring position between electrically connecting said suppressor and said terminal, said spring urging said suppressor into electrical contact with said ball.

* * * * *